United States Patent [19]

Horgan, Jr.

[11] Patent Number: 4,711,480

[45] Date of Patent: Dec. 8, 1987

[54] LATCH ACTUATING DOOR HANDLES

[75] Inventor: William J. Horgan, Jr., Pittsburgh, Pa.

[73] Assignee: Blumcraft of Pittsburgh, Pittsburgh, Pa.

[21] Appl. No.: 936,614

[22] Filed: Dec. 1, 1986

[51] Int. Cl.[4] ..... E05B 3/00

[52] U.S. Cl. ..... 292/336.3; 49/141; 292/166

[58] Field of Search ..... 292/336.3, 166, 168, 292/92; 49/141, 394

[56] References Cited

U.S. PATENT DOCUMENTS

| | | | |
|---|---|---|---|
| 2,232,628 | 2/1941 | North et al. | 292/166 |
| 3,264,025 | 8/1966 | Hawes | 292/166 |
| 4,382,620 | 5/1983 | Horgan | 292/336.3 |

*Primary Examiner*—Kenneth J. Dorner

*Assistant Examiner*—Gerald A. Anderson

*Attorney, Agent, or Firm*—Paul & Paul

[57] ABSTRACT

A latch actuating handle system for a door comprises a bar along and carried by the inside of the door; a bar along and carried by the outside of the door; pivot mounting means carried by the door adjacent a perimeter edge thereof and for mounting the bars for limited pivotal movement between positions toward and away from the door; a latch mechanism longitudinally disposed in the inside handle and terminating in a latch bolt at the end of the bar adjacent the door edge; and a stationary actuator post carried by the door at a location spaced from the pivot mounting means and operatively engagable with the latch mechanism for movement of the latch mechanism between latched and unlatched positions in response to movement of either of the bars.

10 Claims, 9 Drawing Figures

Fig. 6
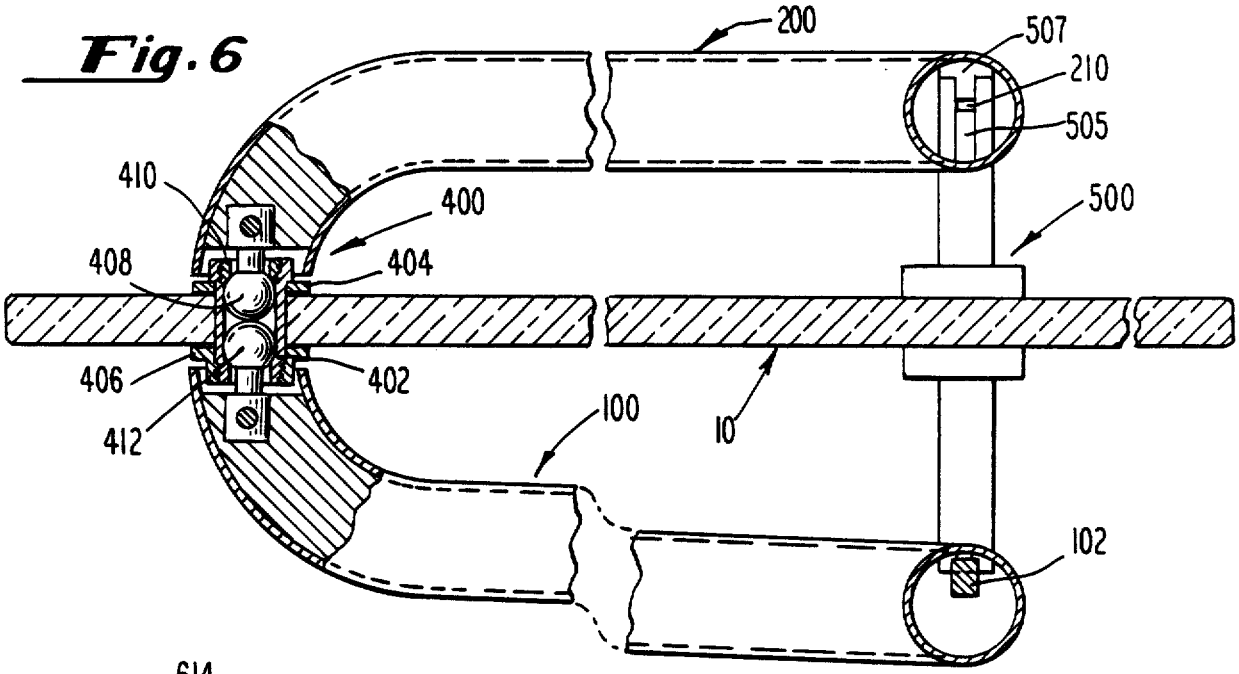
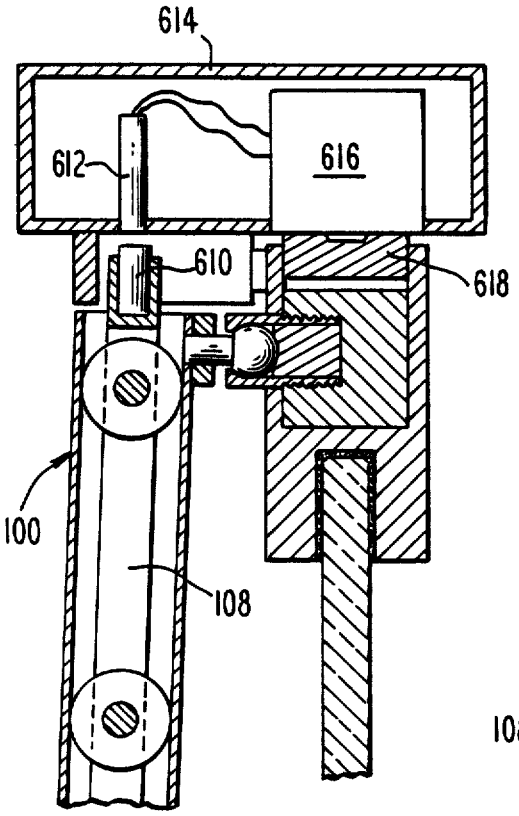
Fig. 8
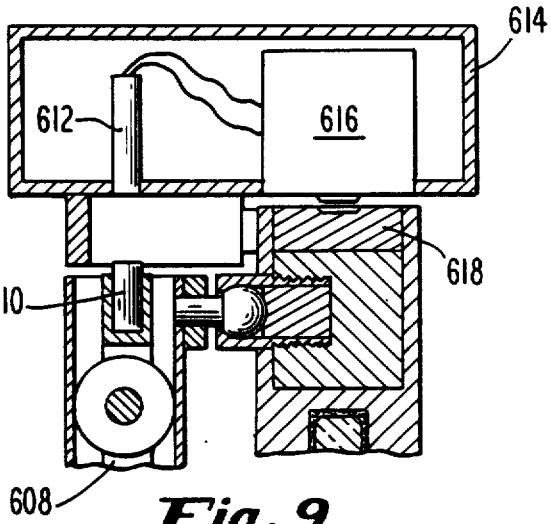
Fig. 9
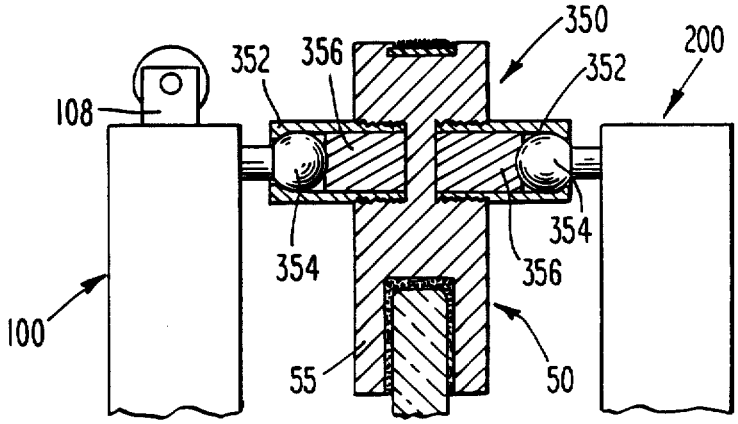
Fig. 7

LATCH ACTUATING DOOR HANDLES

BACKGROUND OF THE INVENTION

This invention relates generally to door handles and more particularly relates to latch actuating door handles. More specifically, the present invention relates to a handle system for doors, wherein the interior door handle actuates a latching mechanism by a simple push-to-release motion and wherein the exterior door handle actuates the latching mechanism by a simple pull-to-release motion.

Latch actuating door handles are generally known in the art. One such well known latch actuating door handle is the panic-type handle described and claimed in my U.S. Pat. Nos. 4,366,974, issued Jan. 4, 1983; 4,382,620, issued May 10. 1983; and 4,418,949, issued Dec. 3, 1983. These above-mentioned patents, the disclosures of which are incorporated herein by reference, teach a panic-type door handle comprising a bar disposed along and carried by a door, having internally a longitudinal latch mechanism which is activated to unlatch the door when the bar is pivoted from a position away from the door to a position close to the door. In each of these patents, the panic handle is on the interior of the door, as would be expected, and the outside of the door is either not provided with a handle or is provided with a stationary handle which does not move relative to the door. Actuation of the latch mechanism from the outside of the door is accomplished by a key and lock mechanism.

The need for key actuation of the latch mechanism from the outside of the door limited the application of these handles to doors at the entrance and exit of a building, in that the need for a key at an internal door would be cumbersome and impractical for most purposes. In fact, the essential purpose of any panic handle device is to facilitate ready exit from a building in the case of emergency. Thus, the most practical location for a door equipped with the panic handle has always been at the exits.

I have invented a handle system for a door which utilizes a panic-type handle on the interior of the door to provide a simple push-to-release feature and which also utilizes a pivoting exterior handle which, when pulled away from the door face, will actuate the latch mechanism to facilitate the opening of the door. As will be discussed more fully herein below, the door handles of the present invention may advantageously be used with automatic door opening devices as well as a variety of latching or locking systems.

SUMMARY OF THE INVENTION

Briefly, the present invention comprises latch actuating door handles comprising an interior bar disposed along and carried by a door, a latch mechanism concealingly longitudinally disposed in the interior bar, an actuator post secured to the door comprising means for actuating the latch mechanism upon movement of the interior bar towards the door; and an exterior bar disposed along and carried by the door, a pivoting toggle member disposed in the exterior bar, and the transverse pin passing through the door in the actuator post and contacting the toggle member, whereby upon movement of the exterior bar away from the door, the toggle member pivots to cause the transverse pin to activate the latch mechanism disposed inside the interior bar. The latch mechanism may be of the known mechanical bolt type or may be operatively coupled with an electromagnetic locking system or an automatic door opening mechanism. Both the interior and the exterior handles are suitably mounted to the door for pivotal movement between their respective positions relative to the door.

Accordingly, it is an object of the present invention to provide latch actuating door handles in which the latch can be actuated from a handle on either side of the door.

It is another object of the invention to provide latch actuating door handles having a push-to-release interior handle and a pull-to-release exterior handle.

It is another object of the invention to provide latch actuating door handles which are usable with a variety of door latching systems.

It is a further object of the invention to provide latch actuating door handles which are usable with an automatic door opening system.

It is a further object of the invention to accomplish the above objects in a door having an aesthetically pleasing ap- pearance.

It is a further object of the invention to accomplish the above objects by providing an interior handle and an exterior handle in mirror image relation to one another with respect to a door, wherein a latch mechanism is concealingly disposed in the interior handle and wherein means are provided for actuating the latch mechanism by pulling the exterior handle away from the door, or by pushing the interior handle towards the door.

It is another object of the invention to accomplish the above object by providing a pivoting toggle member in the exterior handle which pivots upon movement of the exterior handle away from the door to actuate the latch mechanism.

It is another object of the invention to provide means for mounting the interior and exterior handles to the door for appropriate pivotal movement in relation thereto.

These and other objects of the present invention will become apparent upon a reading of the detailed description of the embodiments with reference to the drawings, and the appended claims.

BRIEF DESCRIPTION OF THE DRAWINGS

FIG. 6 is a sectional view, partially fragmented, of the handles of the invention taken along line 6—6 of FIG. 1, illustrating the pivotal mounting assembly for the door handles.

FIG. 7 is a partially sectioned view of an alternate embodiment of the mounting assembly for mounting the handles to the door.

FIGS. 8, and 9 are sectioned views illustrating an alternate embodiment of the latch mechanism of the present invention for use with an electromagnetic lock, illustrating the door in the locked and unlocked condition, respectively.

DETAILED DESCRIPTION OF THE EMBODIMENTS

Figure 1:
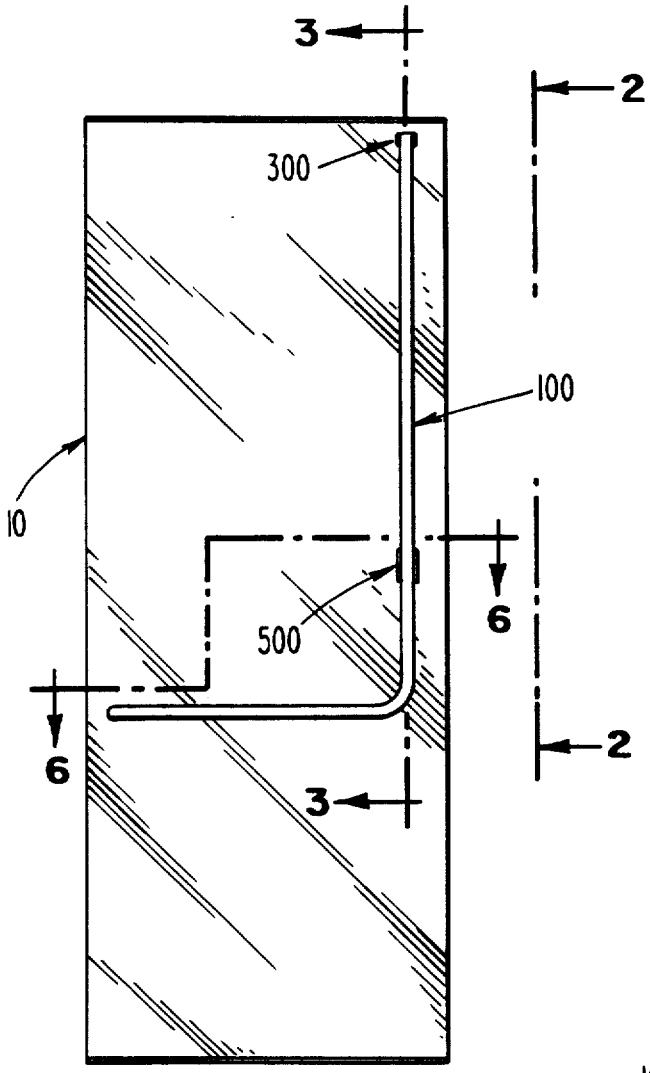
FIG. 1 is a elevational view of a door, in this case made of glass, showing one of the handles of the present invention, the interior handle, mounted thereto, particularly illustrating the smooth aesthetic appearance of the handle.
Figure 2:
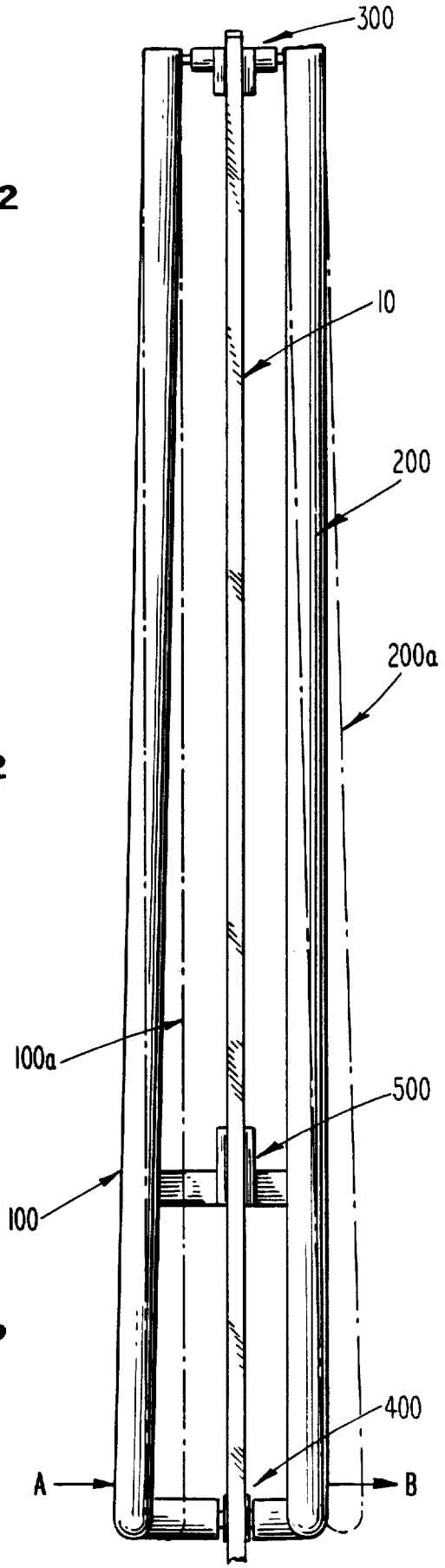
FIG. 2 is a side elevational view of the door of FIG. 1 as seen along line 2—2 of FIG. 1, showing the position of the interior and exterior handles of the present invention and particularly illustrating, in broken lines, the respective actuating positions of the handles.

With reference first being made to FIGS. 1 and 2, the appearance of the handles of the present invention as mounted to a door assembly is illustrated therein. In the embodiment illustrated in the Figures, the door assembly 10 is a typical rectangular glass door, it being understood that the present invention is capable of use with a variety of door types. As seen in FIGS. 1 and 2, the handles of the present invention comprise an interior handle assembly 100 and an exterior assembly 200. Each of these handle assemblies is mounted to door assembly 10 by upper and lower mounting assemblies 300,400, respectively. As will be described more fully below, handle assemblies 100,200 are mounted for limited movement between latched positions (illustrated in solid lines in FIG. 2) and unlatched positions 100*a*, 200*a* (illustrated in FIG. 2 in broken lines) upon application of force to the handle assemblies 100,200 in the direction of arrows "A" and "B" in FIG. 2. An actuator post assembly 500 is engagable by either of handle assemblies 100,200 and comprises the means for actuating the latching mechanism disposed within interior handle assembly 100, as more fully described hereinbelow.

Figure 3:
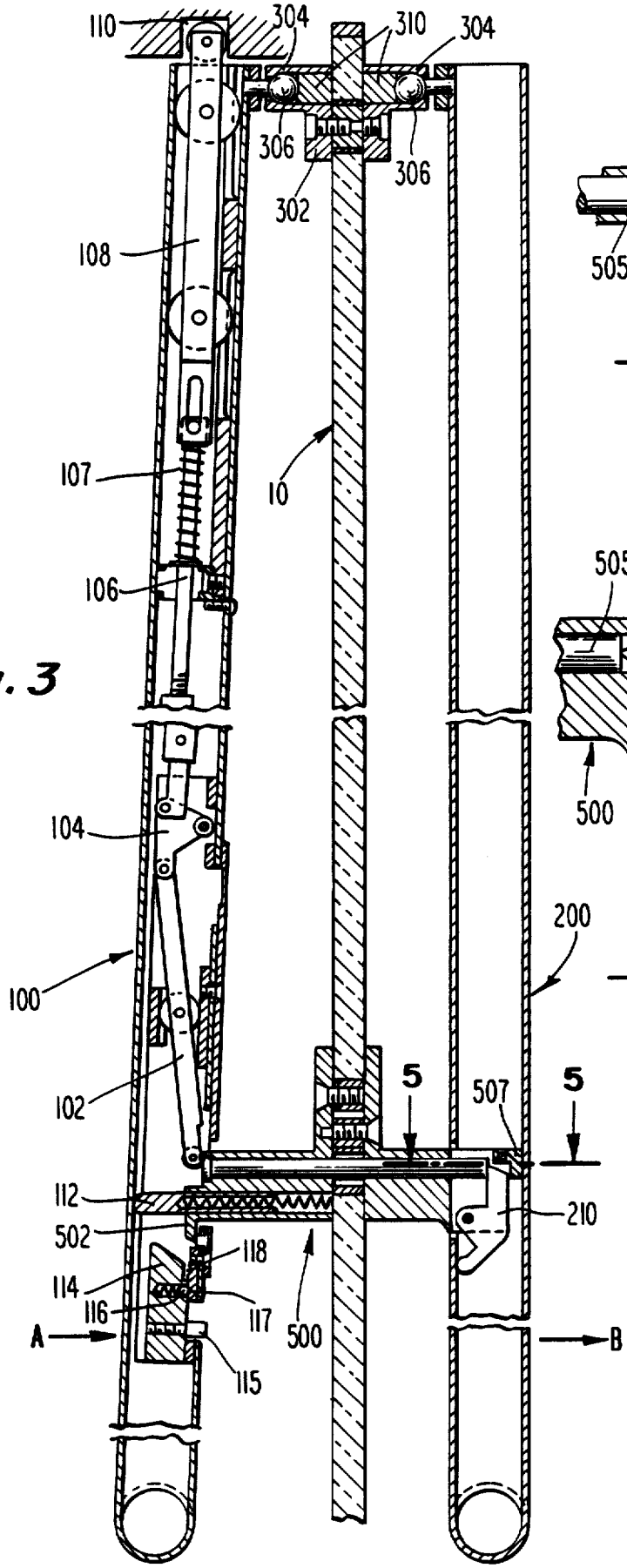
FIG. 3 is a sectional view, partially fragmented, of the door and handles of the invention taken along line 3—3 of FIG. 1, particularly illustrating the latching mechanism, in this case the mechanical bolt type, and the means for actuating the latch mechanism by movement of the handles.
Figure 5:
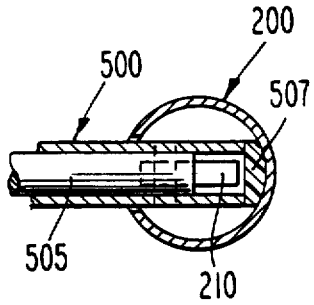
FIG. 5 is a plan view, partially sectioned, of the pivoting toggle member taken along line 5—5 of FIG. 3.
Figure 4:
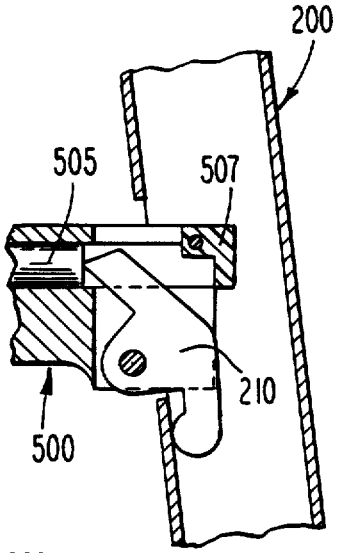
FIG. 4 is an enlarged sectional view of the means for actuating the latch mechanism from the exterior handle, specifically the pivoting toggle member, illustrated in the actuating condition.

With reference to FIGS. 3-5, the internal structure and operation of the handles of the present invention will now be described. As seen in FIG. 3, handle assemblies 100,200 are substantially hollow bars or tubes, into which are disposed the means for latching and unlatching door assembly 10 in response to the pivotal movement of the handle assemblies. More specifically, as seen in FIG. 3, a latching mechanism is disposed within interior handle assembly 100 where it is concealed from view to present a smooth appearance to the handles and door combination. The latching mechanism, as illustrated in FIG. 3, may be identical to that described in my above-referenced U.S. Patents and briefly comprises a lever arm 102, an over-center mechanism 104, a connecting rod 106, and a latch bolt 108. As illustrated in FIG. 3, the latch bolt 108 is disposed within the latch recess 110, whereby the door assembly 10 is secured in the locked position.

Upon application of force to interior hahdle assembly 100 in the direction of arrow A, handle assembly 100 moves towards door assembly 10 and the actuator post assembly 500 penetrates the handle assembly 100 whereby the force applied to lever arm 102 from the end of the actuator post assembly 500 causes lever arm 102 to shift position. The movement of lever arm 102 causes the over-center mechanism 104 to change position, which in turn moves connecting rod 106 downwardly to withdraw the latch bolt 108 from latch recess 110 into the end of handle assembly 100, thus unlatching door assembly 10. Upon removal of the exterior force A, interior handle assembly 100 is restored to its latched position, away from the door, by the spring-loaded plunger 112 urging against the interior of handle assembly 100 and spring 107 urging against latch bolt 108.

A dog mechanism 114 is provided to secure the handle assembly 100 in its innermost position whereby the door assembly 10 is permanently unlatched and the handle assembly 100 functions as a stationary door handle. Dog mechanism 114 may be moved upwardly by slide member 115 to engage the inward lip 502 of actuator post assembly 500 and secure handle assembly 100 in the unlatched position. Dog mechanism 114 is retained in its upper or lower positions by the spring-loaded locking detent 116 being disposed within notches 117,118, respectively.

The exterior handle assembly 200 is disposed along the outside of door assembly 10 and also engages actuator post assembly 500. As seen in FIGS. 3-5, a toggle member 210 is pivotally connected to the end of actuator post assembly 500 and disposed within handle assembly 200 in contact with an inner wall thereof. Upon application of force to exterior handle assembly 200 in the direction of arrow B, handle assembly 200 moves away from door assembly 10, and toggle member 210 pivots into the position illustrated in FIG. 4 by the force applied to toggle member 210 by the inner wall of handle assembly 200. The pivoting of toggle member 210 into the position illustrated in FIG. 4 causes the transverse actuating rod 505 to shift leftwardly, as seen in FIGS. 3 and 4, which in turn initiates the sequence of events mentioned above to unlatch the door. Specifically, the leftward shift of actuating rod 505 causes lever arm 102 to shift which, by shifting over-center member 104, causes connecting rod 106 and latch bolt 108 to shift downwardly into interior handle assembly 100 and unlatch door assembly 10.

Exterior handle assembly 200 is returned to its original latched position toward door assembly 10 upon removal of force "B" by the same spring-loaded plunger 112 and spring 107 which return handle assembly 100 to its original position as described above. A rubber bumper 507 is provided at the end of actuator post 500 to contact the inner wall of handle assembly 200, as shown, to prevent noise or undue damage. Of course, if handle assembly 100 is fixed in the inwardmost position, the door is unlatched and actuation of the latch by exterior handle assembly 200 is unnecessary and, therefore, ineffective.

As also seen in FIG. 3, handle assemblies 100,200 are mounted at their upper end to door assembly 10 by an upper mounting assembly 300. Mounting assembly 300, in the embodiment of FIG. 3 is designed for use with a door not having a frame and, thus, is directly secured to the glass. It being understood, however, that various modifications of upper mounting assembly 300 may be affected for use with doors of different structure and configuration and, accordingly, an alternate embodiment of upper mounting assembly 350 is illustrated in FIG. 7 for use with a door assembly 50 having a frame 55.

In the embodiment of FIG. 3, upper mounting assembly 300 comprises a stepped-section member 302 affixed to each side of the door having a cylindrical support section 304 into which a pivot ball 306 is disposed to support handle assemblies 100,200 in their proper orientation and to allow the handle assemblies to pivot to their respective actuating positions as mentioned previously. A cylindrical spacer plug 310 is provided to properly orientate the handle assemblies 100,200. With reference to the embodiment in FIG. 7, the cylindrical support members 352 are secured directly to the door frame 55 and house pivot balls 354 to support the handle assemblies. Similar spacer plugs 356 are used for proper orientation of the handle.

With reference now being made to FIG. 6, the lower mounting assembly 400 facilitates the mounting of handle assemblies 100,200 to the door assembly 10 whereby the handles appear as a continuous piece when used in connection with a glass door, thus providing a pleasing aesthetic appearance. Lower mounting assembly 400 also provides for pivotal movement of the handle assemblies 100,200 between their respective latching and unlatching positions, and comprises a cylindrical member 402 transversely disposed through the door 10, having an annular flange 404 at one end thereof and fixed in place by a removable collar 406. A pivot ball 408 is securely affixed to handle assembly 200 and is disposed within cylindrical member 402 by a tapped insert 410. A similar pivot ball 412 is connected to handle assembly 100 and retained in cylindrical member 402. The pivot balls 408,412 provide the requisite freedom of movement for the handle assemblies 100,200 to be moved between their respective positions relative to the door to latch or unlatch the door.

With reference now being made to FIGS. 8 and 9, illustrated therein is an alternate embodiment of the latch bolt adapted for use with an electromechanical door locking system. As seen in FIGS. 8 and 9, the end of the latch bolt 608 has been removed and replaced with a magnet 610. When handle assembly 100 is in its outermost position, latch bolt 608 is in its uppermost position, as described above with reference to FIG. 3. As seen in FIG. 8, when in its uppermost position, latch bolt 608 places magnet 610 in operating proximity with a magnetic switch 612 which is concealingly disposed within the transom or header 614 of the door. When activated, the magnetic switch 612 operates the electromagnetic lock 616 which draws up locking plate 618 and secures the door in the locked position. Upon movement of handle assembly 100 towards the door, the previously mentioned sequence of events will be intiated to move latch bolt 608 and magnet 610 downwardly, as seen in FIG. 9, out of the range of magnetic switch 612 and electromagnetic lock 616 will be deactivated to release locking plate 618 and the door will be unlocked.

Although it has not been illustrated in FIGS. 8 and 9, it is to be understood that an exterior handle assembly may be used in connection with the embodiment of FIGS. 8 and 9 whereby the electromagnetic locking system would be actuated by movement of either the interior or exterior handle assemblies. Furthermore, it is to be understood that in place of the electromagnetic locking system just described, an automatic door opening system, such as that manufactured by Stanley, K Corporation, or Keane Monroe may be utilized, particularly if the handles of the present invention are used on large or heavy doors or in high traffic areas. The handle assemblies of the present invention are particularly desirable for use with either an electromagnetic locking system or an automatic door opening system because, as seen in FIGS. 8 and 9, all of the electrical and other operating components of such system can be disposed in the transom or header of the door, and thus eliminate the need for having wires or other elements disposed in the handle assemblies themselves as is typical with such systems.

Preferred forms of the present invention have been described herein for purposes of illustration only and are not to be construed as limitations of the invention. Upon a reading of the above specification, various modifications and alternatives may suggest themselves to those skilled in the art, all of which are intended to be within the spirit and scope of the present invention as defined by the appended claims. For example, although in the preferred embodiment the handle assemblies are L-shaped, it is to be understood that numerous other suitable shapes are available, such as a straight bar or a U-shaped handle. In addition, references herein to "interior", "exterior", "upper", "lower", and other like terms are used for purposes of clarity only and with reference to the particular embodiments being described and are not to be construed as specific limitations of the present invention.

What is claimed is:

1. A door in combination with actuating handles, comprising:

(a) a bar along and carried by the inside of the door;

(b) a bar along and carried by the outside of the door;

(c) pivot mounting means carried by the door adjacent a perimeter edge thereof and for mounting said bars for limited pivotal movement between positions toward and away from the door;

(d) a latch mechanism longitudinally disposed in said inside bar and terminating in a latch bolt at the end of the bar adjacent said door edge;

(e) a stationary actuator post carried by said door at a location spaced from said pivot mounting means and operationally engagable with said latch mechanism for movement of said latch mechanism between latched and unlatched positions in response to movement of either of said bores;

(f) a toggle member disposed within said outside bar and connected to said actuator post for pivotal movement in response to movement of said outside bar away from said door, and wherein said toggle member is operatively coupled to said latch mechanism to move said latch mechanism to an unlatched position in response to the movement of said toggle member;

(g) means for operatively securing said inside bar and actuator post relative to each other with said inside bar in a position toward said door, whereby said inside and outside bars are affixed in a non-movable position and wherein said latch mechanism is maintained in an unlatched position.

2. The door and handles combination of claim 1, wherein said latch mechanism is moved to an unlatched position in response to movement of said outside bar to a position away from said door.

3. The door and handles combination of claim 1, wherein said latch bolt is operatively coupled to an electromagnetic locking system.

4. The door and handles combination of claim 1, wherein said latch bolt is operatively coupled to an automatic door opening system.

5. The door and handles combination of claim 1, wherein said bars are of the generally hollow type.

6. The door and handles combination of claim 1, wherein the door is of the glass-like type.

7. The door and handles combination of claim 1, wherein said perimeter door edge, to which said latch bolt is adjacent, is one of the horizontal door edges.

8. The door and handles combination of claim 1, wherein said bars have at least two legs at generally right angles to one another, with the two ends of the bars being pivotally mounted relative to the door.

9. The door and handles combination of claim 8, wherein said pivot mounting means for mounting one end of said bars to said door comprises a cylindrical member transversely disposed through said door and secured thereto by a collar member, and a pivot ball connected to each of said bars and disposed within said cylindrical member.

10. The door and handles combination of claim 1, wherein said door is of the glass-like type and wherein said inside and outside bars are disposed in mirror-image relation to one another with respect to said door.

* * * * *

UNITED STATES PATENT OFFICE

CERTIFICATE OF CORRECTION

Patent No. 4,711,480 Dated December 8, 1987

Inventor(s) William J. Horgan, Jr.

It is certified that error appears in the above-identified patent and that said Letters Patent are hereby corrected as shown below:

Column 6, line 37, "bores" should be "bars".

Column 6, line 46, "operatively" should be "optionally".

Signed and Sealed this

Seventh Day of June, 1988

*Attest:*

DONALD J. QUIGG

*Attesting Officer*

*Commissioner of Patents and Trademarks*